US005323966A

United States Patent [19]

Buchholz et al.

[11] Patent Number: 5,323,966

[45] Date of Patent: Jun. 28, 1994

[54] APPARATUS FOR INJECTING A FUEL-AIR MIXTURE

[75] Inventors: Juergen Buchholz, Lauffen; Martin Maier, Moeglingen, both of Fed. Rep. of Germany

[73] Assignee: Robert Bosch GmbH, Stuttgart, Fed. Rep. of Germany

[21] Appl. No.: 935,715

[22] Filed: Aug. 27, 1992

[30] Foreign Application Priority Data

Sep. 7, 1991 [DE] Fed. Rep. of Germany ..... 4129834

[51] Int. Cl.[5] ..... B05B 7/12; F02M 61/00

[52] U.S. Cl. ..... 239/408; 239/533.12; 239/585.4; 239/585.5

[58] Field of Search ..... 239/408, 533.12, 585.1, 239/585.4, 585.5; 123/531

[56] References Cited

U.S. PATENT DOCUMENTS 3,680,794 8/1972 Romann et al. ..... 239/585.5 X
4,264,040 4/1981 Saito ..... 239/585.1
4,519,370 5/1985 Iwata ..... 239/533.12 X
4,545,354 10/1985 Jaggle et al. .
4,676,216 6/1987 Ohsawa et al. ..... 239/585.5 X
4,957,241 9/1990 Roger ..... 239/585.1 X
5,193,743 3/1993 Romann et al. ..... 239/585.5 X
5,197,672 3/1993 Grytz et al. ..... 239/585.5 X

FOREIGN PATENT DOCUMENTS 3240554 5/1984 Fed. Rep. of Germany .

*Primary Examiner*—Andres Kashnikow
*Assistant Examiner*—William Grant
*Attorney, Agent, or Firm*—Edwin E. Greigg; Ronald E. Greigg

[57] ABSTRACT

An apparatus for injecting a fuel-air mixture, including a cup-shaped gas delivery hood with a bottom part of a jacket part between the valve end of a fuel injection valve and a gas delivery element, the jacket part has at least one gas delivery opening through which gas is injected and which strikes the injected fuel. The size of the opening cross section, which meters the gas, of the at least one gas delivery opening is accordingly fixed from the very outset and need not be adjusted. Moreover, because of a directional flow of the delivery of gas, very good atomization of the fuel is attained. The embodiment of the apparatus is especially well-suited for use in mixture-compressing internal combustion engines with externally supplied ignition.

16 Claims, 3 Drawing Sheets

APPARATUS FOR INJECTING A FUEL-AIR MIXTURE

BACKGROUND OF THE INVENTION

The invention is based on an apparatus for injecting a fuel-air mixture into an intake tube of a mixture-compressing internal combustion engine. German Patent Document 32 40 554 A1 (U.S. Pat. No. 4,545,354) has already disclosed an apparatus for injecting a fuel-air mixture that relates to a throttle tang-type injection valve with a gas guide element; the injection opening of the injection valve is surrounded, in the immediate vicinity of the gas guide element, by an annular gas gap communicating with an annular gas conduit. However, this apparatus has the disadvantage that because of production tolerances, the annular gas gap that meters the gas and is predetermined by engine requirements must be adjusted by displacement or bending of the gas guide element. Adapting the annular gas gap entails high costs in large-scale mass production of this known apparatus. Because of capillary action, the danger exists in the known apparatus that during operation without the delivery of gas, fuel may intermittently enter the annular gas conduit through the annular gas gap, so that when gas flow ensues, an undesirable enrichment of the fuel-air mixture can occur.

OBJECT AND SUMMARY OF THE INVENTION

The apparatus according to the invention for injecting a fuel-air mixture has an advantage over the prior art that the quantity of gas delivered through the at least one gas delivery opening need not be adjusted by measurement during assembly but instead is defined by the size of the opening cross section of the gas delivery opening. Through the at least one gas delivery opening, the gas is injected and aimed at an injected fuel stream, resulting in very good atomization of the fuel. In this way a maximally homogeneous fuel-gas mixture is created, which assures low pollutant emissions, good acceleration performance, and low fuel consumption of an internal combustion engine.

Since each of the gas delivery openings embodied in the jacket part of the gas delivery hood has an aimed gas stream that meets the injected fuel, the jacket part can be spaced apart by a greater distance from the injected fuel. As a result, in operation of the apparatus without gas delivery, the danger that a fuel film will form on the wall of the gas delivery hood and thus form relatively large fuel droplets is avoided, and during operation without gas delivery, fuel is reliably prevented from flowing through the at least one gas delivery opening onto the radially outer side of the gas delivery hood into a gas chamber surrounding the gas delivery hood.

The use of various gas delivery hoods, for instance with a variable number or size of gas delivery openings, makes it possible to adapt the gas quantity and stream form to given requirements of the engine without requiring adjustment of the apparatus. Moreover, the apparatus according to the invention can be manufactured simply and economically.

It is advantageous if the bottom part of the gas delivery hood is oriented toward the valve end of the fuel injection valve and the jacket part of the gas delivery hood widens frustoconically in the direction of the retaining shoulder of the gas guide element. This lessens the danger that particularly in apparatus operation without gas delivery, a fuel film will deposit on the jacket part of the gas delivery hood and cause the formation of relatively large fuel droplets.

For particularly simple, economical manufacture of the apparatus it is advantageous if the bottom part of the gas delivery hood rests on the valve end of the fuel injection valve, and if at least one injection opening is formed in the bottom part.

It is especially advantageous if at least one gas delivery opening is inclined relative to the longitudinal valve axis. The gas for instance meets the injected fuel on an incline relative to the fuel flow direction, which provides for particularly good fuel atomization.

It is advantageous if the gas delivery hood is formed by deep-drawing of a metal sheet. Such a gas delivery hood can be manufactured especially simple and economically.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
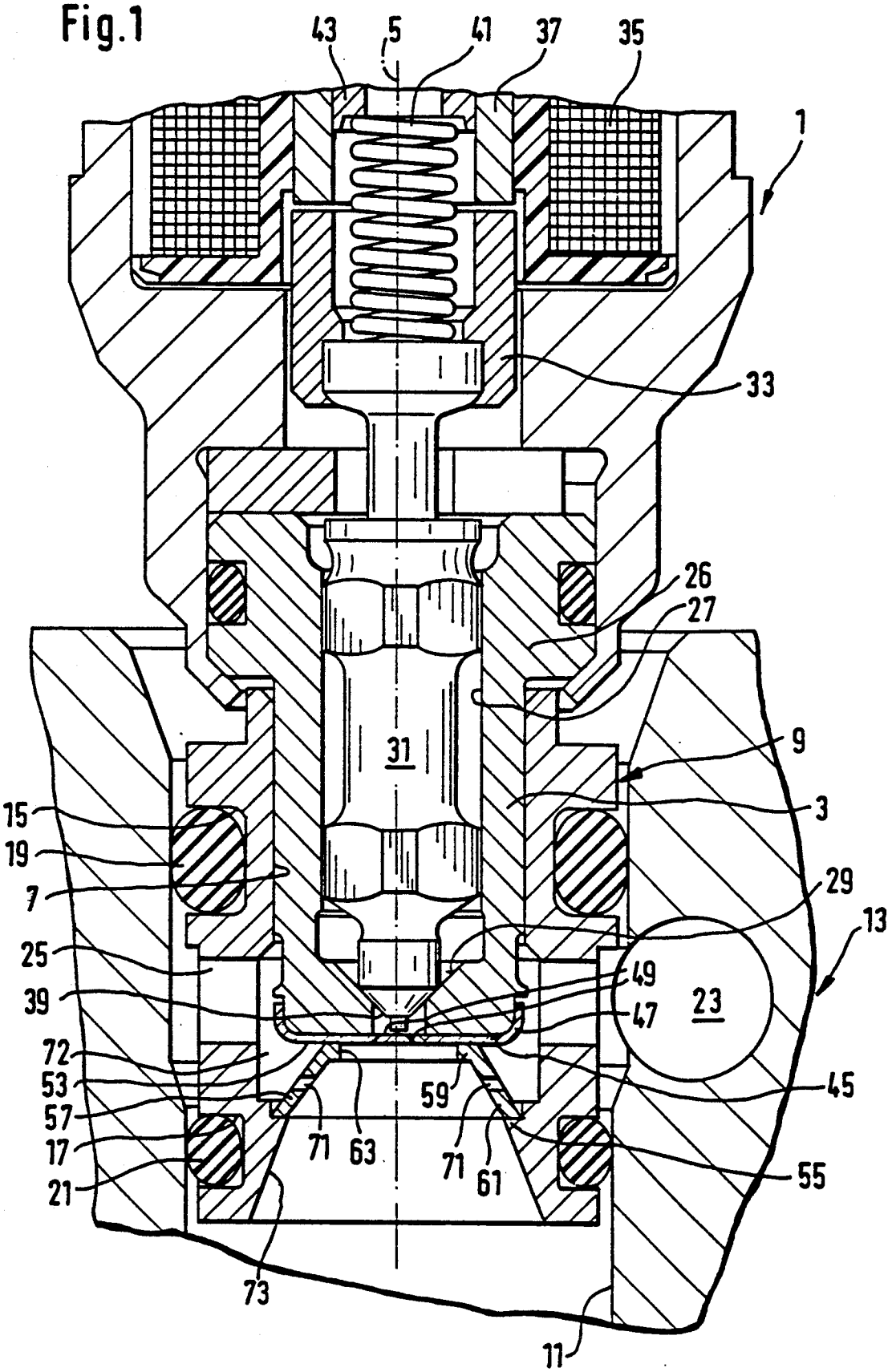
FIG. 1 shows a first exemplary embodiment of the apparatus according to the invention, with a fragmentary view of the fuel injection valve.
Figure 2:
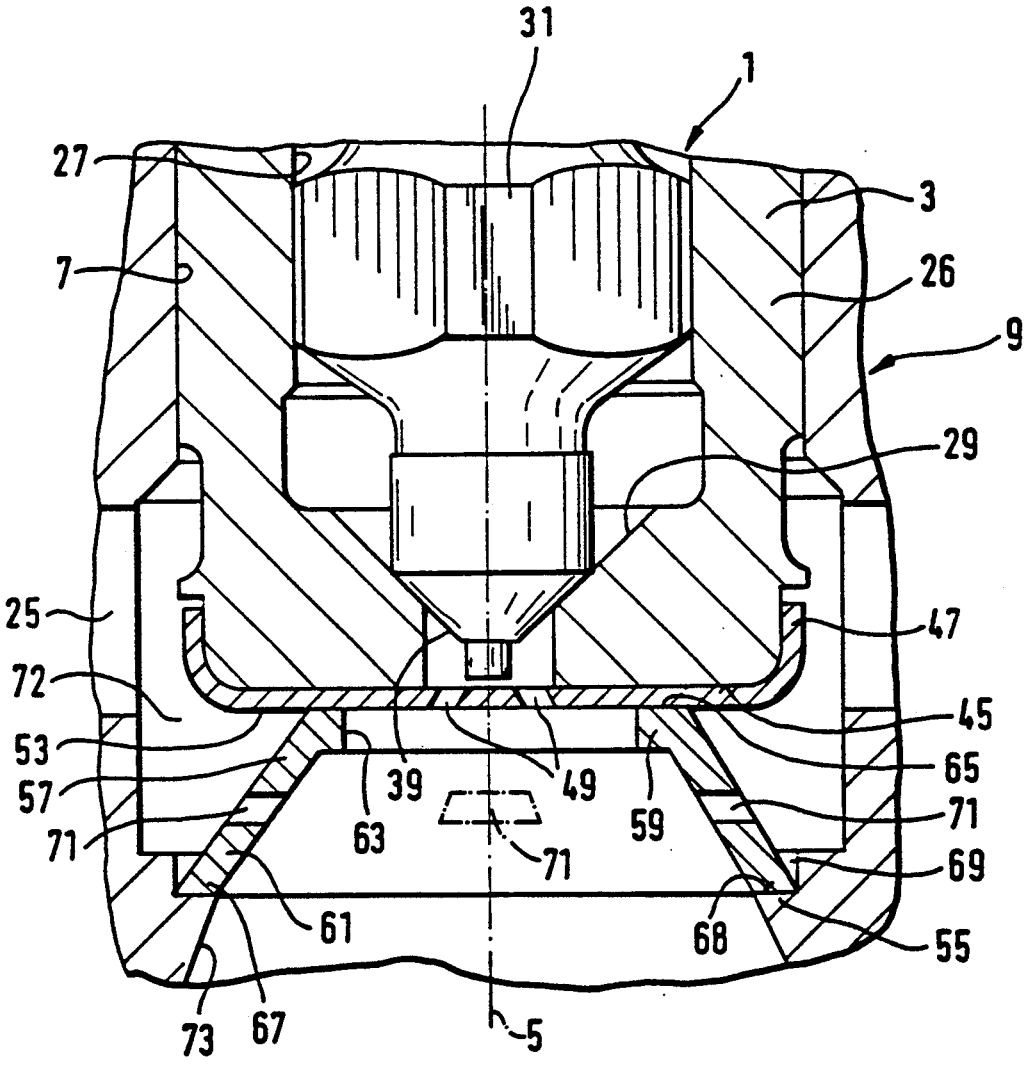
FIG. 2 is a detail of FIG. 1, on a greatly enlarged scale.
Figure 3:
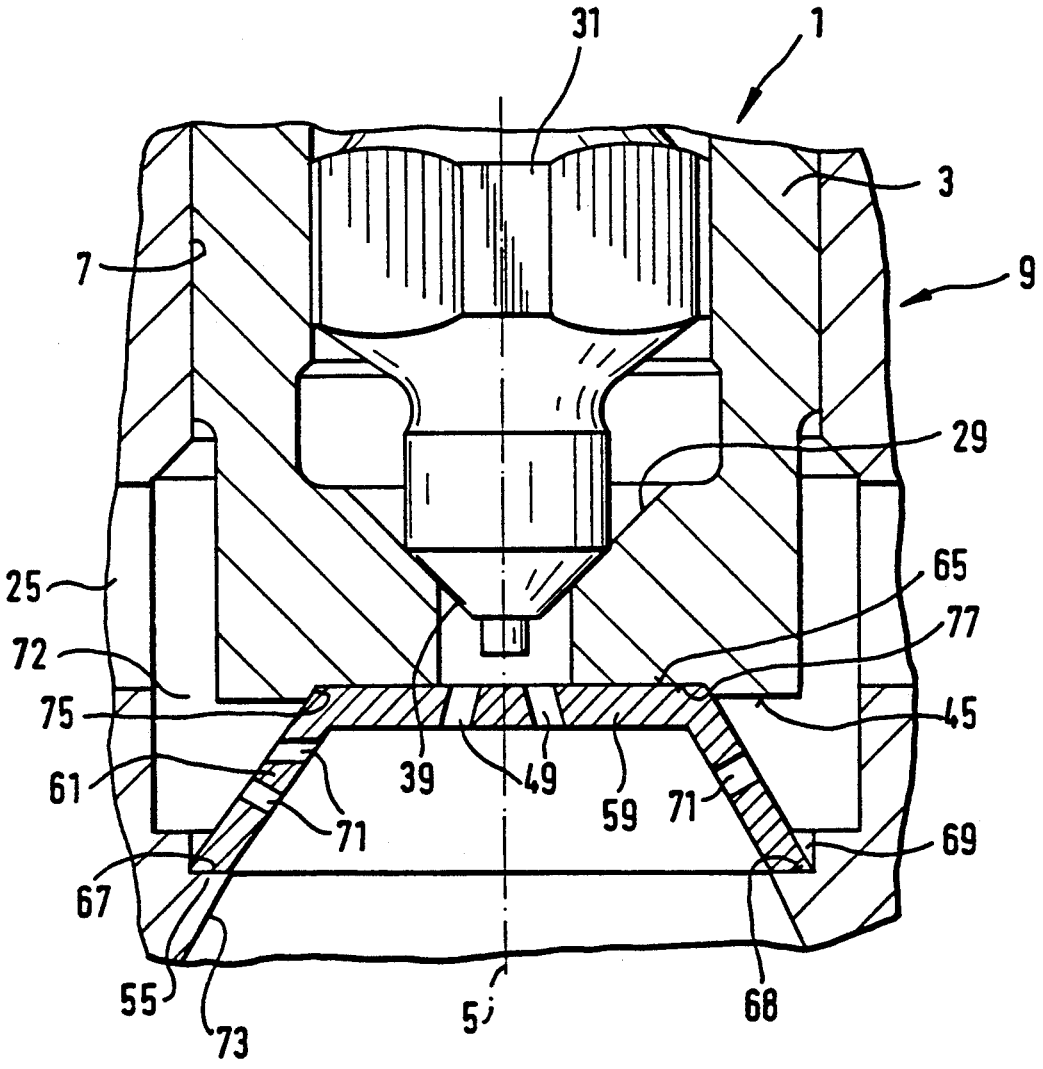
FIG. 3 shows a second exemplary embodiment of the apparatus of the invention, with a fragmentary view of a fuel injection valve.

The apparatus for injecting a fuel-gas mixture into an intake tube or directly into the combustion chamber of a mixture-compressing internal combustion engine with externally supplied ignition, shown in FIGS. 1 to 3 by way of example, have a fuel injection valve 1 with a valve end 3. With its valve end 3, the fuel injection valve 1 protrudes into a stepped longitudinal bore 7, extending concentrically with a longitudinal valve axis 5 of the fuel injection valve 1, of a gas guide element 9, which is made of aluminum or plastic, for example, and which surrounds the valve end 3. The apparatus, with its gas guide element 9, is for instance disposed in a valve holder opening 11 of an intake tube 13.

An upper annular groove 15 and a lower annular groove 17 are formed on the circumference of the gas guide element 9. An upper sealing ring 19 is disposed in the upper annular groove 15, and a lower sealing ring 21 is disposed in the lower annular groove 17. The upper and lower sealing rings 19, 21 rest sealingly against the wall of the valve holder opening 11 of the intake tube 13. A gas delivery conduit 23, which can be used to deliver gas to a plurality of gas guide elements 9, is for instance provided in the intake tube 13. The gas delivery conduit 23 is embodied such that between the upper annular groove 15 with its upper sealing ring 19 and the lower annular groove 17 with its lower sealing ring 21 it discharges preferably at a tangent into the valve holder opening 11 of the intake tube 13.

In the axial direction between the upper sealing ring 19 and the lower sealing ring 21, the gas guide element 9 has transverse openings 25, for instance two in number, extending at right angles to the longitudinal valve axis 5 and extending through the wall of the gas guide element 9 and serving to deliver the gas into the longitudinal bore 7 of the gas guide element 9. The valve end 3 of the fuel injection valve 1 has a nozzle body 26 with a continuous longitudinal bore 27. A fixed valve seat 29, for instance tapering conically in the fuel flow direction, is embodied in the longitudinal bore 27 and cooperates with a valve closing element 31. On its end remote from the fixed valve seat 29, the valve closing element 31 is connected to an armature 33. The armature 33 cooperates with a magnet coil 35 partly surrounding it axially and with a core 37 that faces it in the direction remote from the fixed valve seat 29. A sealing segment 39 of the valve closing element 31 that cooperates with the fixed valve seat 29 tapers frustoconically, for example, in this fuel flow direction. A restoring spring 41 rests with one end on the end of the valve closing element 31 connected to the armature 33. With its other end, the restoring spring 41 is supported on an adjusting sleeve 43 that for example is nonmagnetic and for example is of brass. The restoring spring 41 urges the valve closing element 31 in the direction of the fixed valve seat 29.

In the first exemplary embodiment shown in fragmentary form in FIGS. 1 and 2, with FIG. 2 showing a greatly enlarged detail of FIG. 1, a perforated plate 47 rests on a face end 45 of the nozzle body 26 remote from the core 37. The perforated plate 47 has for example two injection ports 49, which are inclined outward, for example, in terms of the fuel flow direction relative to the longitudinal valve axis 5 and through which the fuel flowing past the fixed valve seat 29 is injected when the valve closing element 31 is raised. The perforated plate 47 forms the lower face end 53 of the valve end 3 of the fuel injection valve 1 and is joined to the valve end 3, for example by welding.

The stepped longitudinal bore 7 of the gas guide element 9 has a retaining shoulder 55 extending radially inward downstream of the valve end 3 of the fuel injection valve 1. A cup-shaped gas delivery hood 57 is disposed in the direction of the longitudinal valve axis 5, resting as tightly as possible between the valve end 3 of the fuel injection valve 1 in the retaining shoulder 55 of the gas guide element 9; this hood has a bottom part 59 and a jacket part 61 that extends concentrically with the longitudinal valve axis 5. A through opening 63 is formed in the bottom part 59 concentric with the longitudinal valve axis 5.

With an upper face end 65 of its bottom part 59, the gas delivery hood 57 rests on the lower face end 53 of the valve end 3 formed by the perforated plate 47; the through opening 63 extends beyond the injection ports 49 of the perforated plate 47, and fuel injected out of the injection ports 49 flows through the through opening 63. The jacket part 61 of the gas delivery hood 57 extends in the direction remote from the valve end 3 as far as the retaining shoulder 55 of the stepped longitudinal bore 7, and with one end 67, remote from the bottom part 59, the jacket part 61 rests on a bearing face end 68 of an annular retaining groove 69 embodied in the retaining shoulder 55 and oriented toward the valve end 3 of the fuel injection valve. The jacket part 61 of the gas delivery hood 57 widens frustoconically, for example in the direction of the retaining shoulder 55.

At least one gas delivery opening 71, and two such openings in the first exemplary embodiment, for example, are formed in the jacket part 61; the openings 71 penetrate the wall of the jacket part 61 and extend approximately at right angles to the longitudinal valve axis 5, for example. It is equally possible for the gas delivery openings 71 to be embodied arbitrarily differently relative to the longitudinal valve axis 5, for example inclined obliquely from the longitudinal valve axis 5 in the direction away from the fuel injection valve 1. The gas delivery openings 71 may have a circular, slit-like (as suggested in FIG. 2 by dashed lines) or other arbitrary opening cross section, and are formed by erosion, for example.

The gas delivery openings 71 communicate with a gas chamber 72, which is reached by the gas through the transverse openings 25 and is formed by the valve end 3, the wall of the longitudinal bore 7 and the circumference of the jacket part 61; these gas delivery openings serve to deliver the gas to the fuel injected through the injection ports 49 of the perforated plate 47. The gas emerging in a stream from the relatively narrow gas delivery openings 71 strikes the injected fuel, finely atomizes it, and leads to the formation of a maximally homogeneous fuel-air mixture, which is injected through a mixture injection portion 73 of the longitudinal bore 7 of the gas guide element 9 that is embodied downstream of the gas delivery hood 57 and widens frustoconically in the flow direction.

The sides of the free cross section of the gas delivery openings 71 is selected to suit the required throughput of gas, as a function of the quantity of fuel injected by the fuel injection valve, and it affects both the quantity and pressure of the metered gas. If the plurality of gas delivery openings 71 are formed in the jacket part 61 of the gas delivery hood 57, then by means of variable sizes and shapes of the gas delivery openings 71, the gas streams that meet the injected fuel and atomize it can be distributed asymmetrically, so that likewise variable fuel streams are attained. Embodying the jacket part 61 of the gas delivery hood 57 so that it widens frustoconically in the mixture flow direction lessens the danger of fuel film formation on the wall of the jacket part 61 and thus lessens the danger that large fuel droplets will form.

Either fresh air or inert gas or a mixture of the two may be used as the gas to form a fuel gas mixture. The fresh air is for instance diverted from the intake tube upstream of an arbitrarily adjustable throttle device and is delivered to the gas delivery conduit 23. The exhaust gas of the engine can for instance be used as the inert gas, so that engine emissions are reduced by this exhaust gas recirculation. The gas can also be pumped by a supplementary pump.

A second exemplary embodiment of the apparatus according to the invention is shown in FIG. 3; identical elements that function the same are identified by the same reference numerals as in FIGS. 1 and 2. The second exemplary embodiment differs from the first substantially in that instead of one through opening 63, for instance, in the bottom part 59 there is at least one and for instance two injection ports 49, which are inclined outward by way of example from the longitudinal valve axis 5 in the fuel flow direction, and through which the fuel flowing past the fixed valve seat 29 is injected when the valve closing part 31 is raised. Thus the bottom part 59 has the same function as the perforated plate 47 in the first embodiment of the invention, so that a separate perforated plate 47 is unnecessary. A flat recess 75, for instance of circular form, is made in the face end 45 of the nozzle body 26 concentrically with the longitudinal valve axis 5; the bottom part 59 of the gas delivery hood 57 protrudes into this recess 75. With its upper face end 65, the bottom part 59 rests on a bottom face end 77 of the recess 75.

One gas delivery opening 71, by way of example, is embodied in the jacket part 61 of the gas delivery good 57 shown in the right in FIG. 3; this opening is inclined obliquely toward the longitudinal valve axis 5 in the direction remote from the fuel injection valve 1. The gas injected through the gas delivery opening 71, which has a circular or slit-like opening cross section, for example, strikes the fuel injected through the injection port 49 of the bottom part 59 shown in the right-hand half of FIG. 3 and atomizes this fuel finely.

As shown on the left in FIG. 3, two gas delivery openings 71 may for instance be formed in the jacket part 61, in such a way that both gas delivery openings 71 are aimed at the fuel stream injected through the injection port 49 shown in the left-hand half of FIG. 3; an upper gas delivery opening 71 oriented toward the bottom part 59 extends at right angles, for example, to the longitudinal valve axis 5, and a lower gas delivery opening 71 oriented toward the retaining shoulder 55 is for instance inclined obliquely to the longitudinal valve axis 5 in the mixture flow direction. By the arrival of the gas, delivered through the upper gas delivery opening 71, at the fuel injected through the injection port 49, preatomization of the fuel is attained, and by the arrival of the gas delivered through the lower gas delivery opening 71 at the fuel gas mixture that forms, post atomization of the fuel is attained.

The gas delivery hood 57 is formed for example by deep-drawing of a metal sheet. However, it is also possible to embody the gas delivery hood 57 by aluminum die-casting or plastic injection molding.

The apparatus according to the invention having the gas delivery hood 57 with at least one gas delivery opening 71 has the advantage of a fixed gas delivery cross section and an aimed gas flow direction, with the consequence being especially fine atomization of the fuel, and it is simple to manufacture.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An apparatus for injecting a fuel-gas mixture, having a fuel injection valve that has a longitudinal valve axis and a valve closing element cooperating with a fixed valve seat, and having a gas guide element that has a stepped longitudinal bore extending concentrically with the longitudinal valve axis, one valve end of the fuel injection valve protrudes into the longitudinal bore, a cup-shaped gas delivery hood (57) having a bottom part (59) oriented toward the one valve end (3) of the fuel injection valve (1), and a jacket part (61) is disposed in the direction of the longitudinal valve axis (5) between the one valve end (3) of the fuel injection valve (1) and a retaining shoulder (55) of the gas guide element (9), the jacket part (61) of the gas delivery hood (57) extends in a direction of the retaining shoulder (55) of the gas guide element (9) and has at least one delivery opening (71).

2. An apparatus as defined by claim 1, in which said jacket part (61) includes more than one delivery opening (71).

3. An apparatus as defined by claim 2, in which the bottom part (59) of the gas delivery hood (57) rests on the valve end (3) of the fuel injection valve (1), and includes at least one injection port (49) embodied in the bottom part (59).

4. An apparatus as defined by claim 3, in which said bottom part (59) includes more than one injection port (49).

5. An apparatus as defined by claim 2, in which the jacket part (61) of the gas delivery hood (57) widens frustoconically in the direction of the retaining shoulder (55) of the gas guide element (9).

6. An apparatus as defined by claim 2, in which the bottom part (59) of the gas delivery hood (57) rests on a perforated plate (47) disposed on the one valve end (3) of the fuel injection valve (1) and having at least one injection port (49), and includes a through opening (63) embodied in the bottom part (59).

7. An apparatus as defined by claim 1, in which the jacket part (61) of the gas delivery hood (57) widens frustoconically in the direction of the retaining shoulder (55) of the gas guide element (9).

8. An apparatus as defined by claim 7, in which the bottom part (59) of the gas delivery hood (57) rests on the valve end (3) of the fuel injection valve (1), and includes at least one injection port (49) embodied in the bottom part (59).

9. An apparatus as defined by claim 8, in which said bottom part (59) includes more than one injection port (49).

10. An apparatus as defined by claim 7, in which the bottom part (59) of the gas delivery hood (57) rests on a perforated plate (47) disposed on the one valve end (3) of the fuel injection valve (1) and having at least one injection port (49), and includes a through opening (63) embodied in the bottom part (59).

11. An apparatus as defined by claim 1, in which the bottom part (59) of the gas delivery hood (57) rests on a perforated plate (47) disposed on the one valve end (3) of the fuel injection valve (1) and having at least one injection port (49), and includes a through opening (63) embodied in the bottom part (59).

12. An apparatus as defined by claim 1, in which the bottom part (59) of the gas delivery hood (57) rests on the valve end (3) of the fuel injection valve (1), and includes at least one injection port (49) embodied in the bottom part (59).

13. An apparatus as defined by claim 12, in which said bottom part (59) includes more than one injection port (49).

14. An apparatus as defined by claim 1, in which the at least one gas delivery opening (71) is inclined relative to the longitudinal valve axis (5).

15. An apparatus as defined by claim 1, in which the at least one gas delivery opening (71) of the jacket part (61) is formed as a slit.

16. An apparatus as defined by claim 1, in which the gas delivery hood (57) is formed by deep-drawing a metal sheet.

* * * * *